United States Patent [19]

Kalina

[11] Patent Number: 4,763,480

[45] Date of Patent: Aug. 16, 1988

[54] METHOD AND APPARATUS FOR IMPLEMENTING A THERMODYNAMIC CYCLE WITH RECUPERATIVE PREHEATING

[76] Inventor: Alexander I. Kalina, 12214 Clear Fork, Houston, Tex. 77077

[21] Appl. No.: 920,281

[22] Filed: Oct. 17, 1986

[51] Int. Cl.[4] ..... F01K 25/06

[52] U.S. Cl. ..... 60/649; 60/653; 60/673; 60/691

[58] Field of Search ..... 60/678, 649, 653, 654, 60/673, 691, 692, 693

[56] References Cited

U.S. PATENT DOCUMENTS 3,277,651 10/1966 Augsburger ..... 60/679 X
3,842,605 10/1974 Tegtmeyer ..... 60/678
3,921,406 11/1975 Teranishi et al. ..... 60/678 X
4,003,205 1/1977 Matsumura ..... 60/678 X
4,047,386 9/1977 Frondorf ..... 60/678 X

*Primary Examiner*—Stephen F. Husar
*Attorney, Agent, or Firm*—Arnold, White & Durkee

[57] ABSTRACT

A method and apparatus for implementing a thermodynamic cycle with preheating, involves expanding a gaseous working fluid to a medium pressure to transform its energy into usable form. The expanded gaseous working fluid is split into two different streams. One stream is further expanded to a spent low pressure level to produce further usable energy. This stream is then condensed. The other of the two streams is used to preheat the condensed stream and is mixed with the condensed stream at a point upstream of the point of preheating. This decreases the irreversibilities in the preheating process and enables greater efficiencies to be achieved.

7 Claims, 1 Drawing Sheet

METHOD AND APPARATUS FOR IMPLEMENTING A THERMODYNAMIC CYCLE WITH RECUPERATIVE PREHEATING

BACKGROUND OF THE INVENTION

1. Field of the Invention

This invention relates generally to methods and apparatus for transforming energy from a heat source into a useable form using a working fluid that is expanded and regenerated. This invention further relates to a method and apparatus for improving the heat utilization efficiency of a thermodynamic cycle.

2. Brief Description of the Background Art

In the Rankine cycle, a working fluid such as water, ammonia or freon is evaporated in an evaporator utilizing an available heat source. The evaporated gaseous working fluid is expanded across a turbine to transform its energy into useable form. The spent gaseous working fluid is then condensed in a condenser using an available cooling medium. The pressure of the condensed working medium is increased by pumping, followed by evaporation and so on to continue the cycle.

The Exergy cycle, described in U.S. Pat. No. 4,346,561, utilizes a binary or multi-component working fluid. This cycle operates generally on the principle that a binary working fluid is pumped as a liquid to a high working pressure and is heated to partially vaporize the working fluid. The fluid is then flashed to separate high and low boiling working fluids. The low boiling component is expanded through a turbine, to drive the turbine, while the high boiling component has heat recovered for use in heating the binary working fluid prior to evaporation. The high boiling component is then mixed with the spent low boiling working fluid to absorb the spent working fluid in a condenser in the presence of a cooling medium.

A theoretical comparison of the conventional Rankine cycle and the Exergy cycle demonstrates the improved efficiency of the new cycle over the Rankine cycle when an available, relatively low temperature heat source such as ocean water, geothermal energy or the like is employed.

In applicant's further invention referred to as the Basic Kalina cycle, the subject of U.S. Pat. No. 4,489,563, relatively lower temperature available heat is utilized to effect partial distillation of at least a portion of a multi-component fluid stream at an intermediate pressure to generate working fluid fractions of different compositions. The fractions are used to produce at least one main rich solution which is relatively enriched with respect to the lower boiling component, and to produce one lean solution which is relatively impoverished with respect to the lower boiling component. The pressure of the main rich solution is increased; thereafter, it is evaporated to produce a charged gaseous main working fluid. The main working fluid is expanded to a low pressure level to convert energy to useable form. The spent low pressure level working fluid is condensed in a main absorption stage by dissolving with cooling in the lean solution to regenerate an initial working fluid for reuse.

In any process of converting thermal energy to a useable form, a major loss of available energy in the heat source occurs in the process of boiling or evaporating the working fluid. This loss of available energy (known as exergy or essergy) is due to the mismatch of the enthalpy-temperature characteristics of the heat source and the working fluid in the boiler. Simply put, for any given enthalpy the temperature of the heat source is always greater than the temperature of the working fluid. Ideally, this temperature difference would be almost, but not quite, zero. This mismatch occurs both in the classical Rankine cycle, using a pure substance as a working fluid, as well as in the Kalina and Exergy cycles described above, using a mixture as a working fluid. The use of a mixture as a working fluid in the manner of the Kalina and Exergy cycles reduces these losses to a significant extent. However, it would be highly desireable to further reduce these losses in any cycle.

In the conventional Rankine cycle the losses arising from mismatching of the enthalpy-temperature characteristics of the heat source and the working fluid constitute about 25% of the available energy. With a cycle such as that described in U.S. Pat. No. 4,489,563, the loss of exergy in the boiler due to enthalpy-temperature characteristics mismatching would constitute about 14% of all of the available exergy.

The overall boiling process in a thermodynamic cycle can be viewed for discussion purposes as consisting of three distinct parts: preheating, evaporation and superheating. The quantity of heat in the temperature range suitable for superheating is generally much greater than necessary, or the quantity of heat in the temperature range suitable for evaporation is much smaller than necessary. A portion of the high temperature heat which would be suitable for high temperature superheating is used for evaporation in conventional processes. This causes very large temperature differences between the two streams, and as a result, irreversible losses of exergy.

In accordance with another invention of the applicant, the subject of U.S. Pat. No. 4,604,867, a fluid may be diverted to a reheater after initial expansion in the turbine to increase the temperature available for superheating. After return to the turbine, and additional expansion, the fluid is withdrawn from the turbine and cooled in an intercooler. Afterwards, the fluid is returned to the turbine for additional expansion. The cooling of the turbine gas may provide additional heat for evaporation. Intercooling provides compensation for the heat used in reheating and may provide recuperation of heat available which would otherwise remain unused following final turbine expansion.

In the past preheating of a working fluid is usually performed by extraction of part of the working fluid stream between turbine stages. This is followed by injection of the extracted stream or streams into the stream of feed water to the turbine. As a result heat of a lower temperature level may perform preheating, which occurs at relatively low temperature levels. Therefore, in general, this process increases the efficiency of the power plant.

However, conventional preheating has a drawback, because the steam used for preheating has a temperature which is significantly higher than the temperature of the feed water into which it is injected. This steam may even have a temperature which is higher than the temperature of the feed water obtained after injection. This creates irreversibilities and lowers the potential efficiency of the power plant.

It would be highly desirable to provide a process and apparatus which avoids the creation of these irreversibilities and thereby increases the efficiency of the power plant.

SUMMARY OF THE INVENTION

It is one feature of the present invention to provide a significant improvement in the efficiency of a thermodynamic cycle by permitting closer matching of the working fluid and heat source enthalpy-temperature characteristics during preheating. It is also a feature of the present invention to provide a system of preheating which decreases the irreversibilities and therefore increases the efficiency of the entire system.

In accordance with one embodiment of the present invention, a method of implementing a thermodynamic cycle includes the step of expanding a gaseous working fluid to transform its energy into useable form. The expanded gaseous working fluid is then split into two streams. The first stream is expanded to a spent low pressure level to transform its energy into usable form. The first stream is then condensed. The first and second streams are mixed to form a mixed stream after the second stream is used to preheat at least a portion of the mixed stream. Then the working fluid stream is evaporated to form the gaseous working fluid.

In accordance with another embodiment of the present invention, an apparatus for implementing a thermodynamic cycle includes a first turbine having a fluid inlet path and a fluid outlet path. The fluid outlet path is split into first and second lines. A second turbine is connected for fluid communication with the first line. A heat exchanger is connected for fluid communication with the second line and the first turbine. A condensing system has its output connected for fluid communication with the second turbine. A mixing chamber is connected for fluid communication with the output of the condensing system. The heat exchanger is arranged to transfer heat from fluid flowing from the first turbine to the mixing chamber to fluid flowing from the mixing chamber to the first turbine.

DESCRIPTION OF A PREFERRED EMBODIMENT

Figure 1:
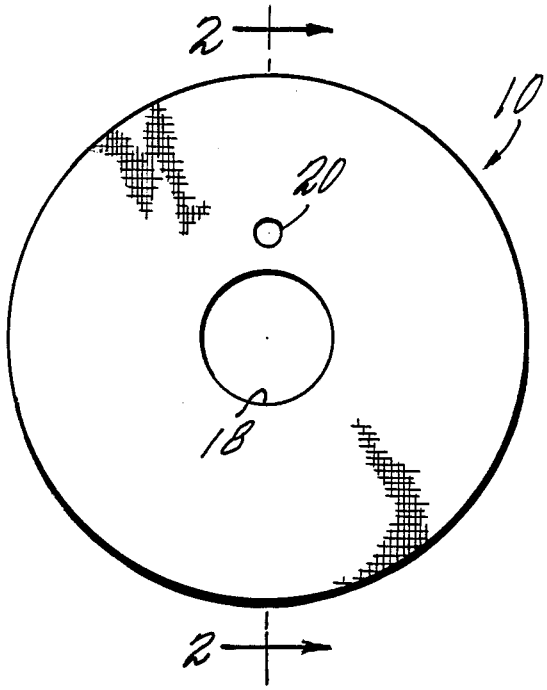
FIG. 1 is a schematic representation of one system for carrying out one embodiment of the method and apparatus of the present invention.

Referring to the drawing wherein like reference characters are utilized for like parts throughout the several views, a system 100, shown in FIG. 1, implements a thermodynamic cycle, in accordance with one embodiment of the present invention. The illustrated system 100 includes a series of three turbines 102, 104 and 106, a condensing subsystem 108, and heat exchangers 110–124.

The condensing subsystem 108 may be any type of known heat rejection device. In the Rankine cycle, heat rejection occurs in a simple heat exchanger and thus for Rankine applications, the subsystem 108 may take the form of a heat exchanger or condenser. In the Kalina cycle, described in U.S. Pat. No. 4,489,563 to Kalina, the heat rejection system requires that gas leaving the turbine be mixed with a multi-component fluid stream, for example, comprised of water and ammonia, condensed and then distilled to produce the original state of the working fluid. Thus, when the present invention is used with a Kalina cycle, the distillation subsystem described in U.S. Pat. No. 4,489,563 may be utilized as a system 108. U.S. Pat. No. 4,489,563 is hereby expressly incorporated by reference herein.

Various types of heat sources may be used to drive the cycle of this invention. For example, heat sources with temperatures as high as, say 1000° F. or more, down to the low heat sources such as those obtained from ocean thermal gradients may be utilized. Heat sources such as for example, low grade primary fuel, waste heat, geothermal heat, solar heat or ocean thermal energy conversion systems may also be implemented with the present invention. However, the present invention is particularly suitable for use with heat produced by the burning of fuel in a fluidized bed or by the burning of municipal wastes or other low grade fuel. Normally in the burning of such fuel, to avoid corrosion, the combustion gases cannot be cooled below a temperature of 300° to 400° F.

A variety of working fluids may be used in conjunction with the system 100 depending on the kind of condensing subsystem 108 utilized. In conjunction with a condensing system 108 described in the U.S. patent incorporated by reference herein, any multi-component working fluid that comprises a lower boiling point fluid and a relatively higher boiling point fluid may be utilized. Thus, for example, the working fluid employed may be an ammonia-water mixture, two or more hydrocarbons, two or more freons, mixtures of hydrocarbons and freons or the like. In general, the fluid may be mixtures of any number of compounds with favorable thermodynamic characteristics and solubility. However, when implementing the conventional Rankine cycle, conventional single component working fluids such as water, ammonia, or freon may be utilized.

As shown in FIG. 1, a completely condensed working fluid which has been slightly preheated and pumped to a high pressure, exits the condensing subsystem 108 and is combined with a returning stream from the pump 126. The fluid exiting the pump 126 is at a temperature, pressure, and mass flow rate relatively close to that of the fluid exiting the condensing subsystem 108. In an illustrative embodiment the pressure of the two streams are substantially the same before they are mixed. After the two streams from the subsystem 108 and the pump 126 are combined at point 128, the working fluid is divided into two streams 130 and 132. The stream 132 is heated in the heat exchanger 122 in counterflow with the fluid in the line 134 returning from the turbine 102. The flow along the path 130 is heated by counterflow in the heat exchanger 124 with the returning stream from the turbine 106.

The returning stream along the path 134 that exits from the turbine 102 is a medium pressure stream relative to the returning streams from the turbine 106. The medium pressure returning stream from the turbine 102 is pumped by the pump 126 as described previously. In the heat exchanger 122, the returning medium pressure stream is condensed, releasing heat of condensation, which heats the stream 132.

The returning stream from the turbine 106, progressing along the line 136, is at a lower pressure than the stream from the turbine 102 which progresses along line 134. This returning stream 136 gives up heat in heat exchanger 124 to heat the fluid flow along the path 130 as described previously.

At point 138, the streams progressing along the paths 130 and 132 are combined and then divided into three streams which pass through heat exchangers 116, 118 and 120 respectively. The stream passing through line 140 is heated by the return stream in the line 136 which exited from the turbine 106. The fluid stream progressing along line 142 is heated by the medium pressure returning stream in line 134 which exits from turbine 102. Finally, the fluid flow through the line 144 is heated by an external heat source in the heat exchanger 116. As a result of the processes occuring in the heat exchangers 116, 118 and 120, each of the exiting flows along the lines 144, 142 and 140 is evaporated and slightly superheated.

Each of these slightly superheated streams are combined and pass through a heat exchanger 110 with heating by an external heat source. The flow exiting from the heat exchanger 110 is sent into the high pressure turbine 102 where it is expanded to a medium pressure to produce work.

The flow exiting from the turbine 102 is divided into two streams. One stream progresses along the path 134 and the other stream progresses along the path 146. The fluid flow through the path 134 is cooled and condensed, as described previously, to provide heat for preheating.

The stream progressing along the path 146 is reheated in heat exchanger 112 and is then expanded in the intermediate pressure turbine 104 to produce work. Thereafter, the stream is reheated in the heat exchanger 114 by an external heat source and then expanded in the low pressure turbine 106 to produce work. The flow exiting from the turbine 106 is a relatively low pressure returning stream. This stream progresses along the path 136 to be cooled in the heat exchanger 120, providing heat for the stream 140 as described previously. Ultimately the stream passes to the subsystem 108.

While the present invention has been described with two stage cooling of the stream progressing along the path 134 and two stage heating of the turbine 102 feed water, those skilled in the art will appreciate that the present invention can be implemented with single, double, triple or multiple stage heating of the feed water and cooling of the flow through the path 134.

Figure 2:
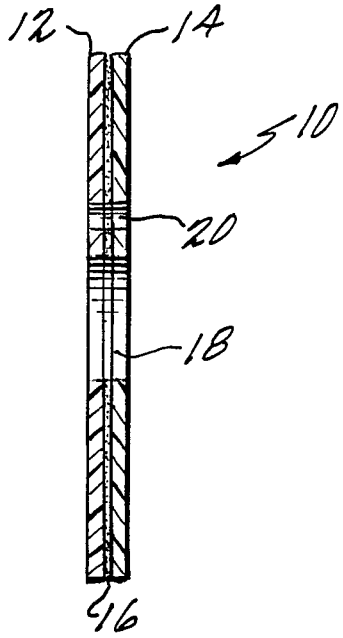
FIG. 2 is a schematic representation of one embodiment of a distillation-condensation subsystem for use in connection with the system shown in FIG. 1.
Figure 3:
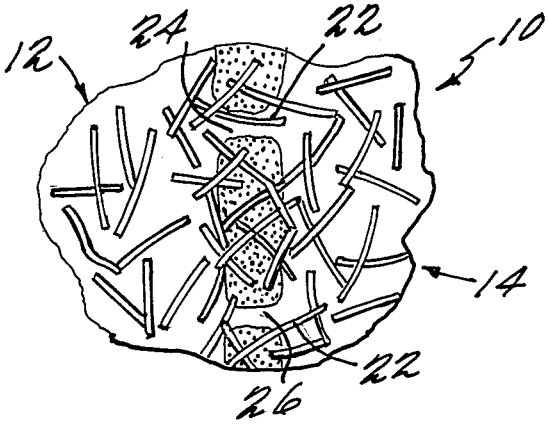
Figure 4:
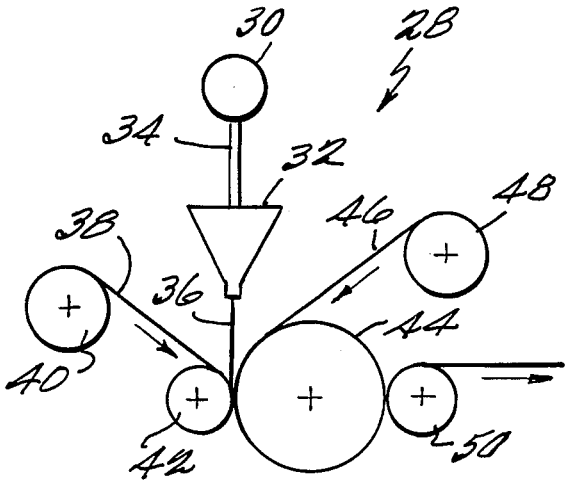
Figure 1:
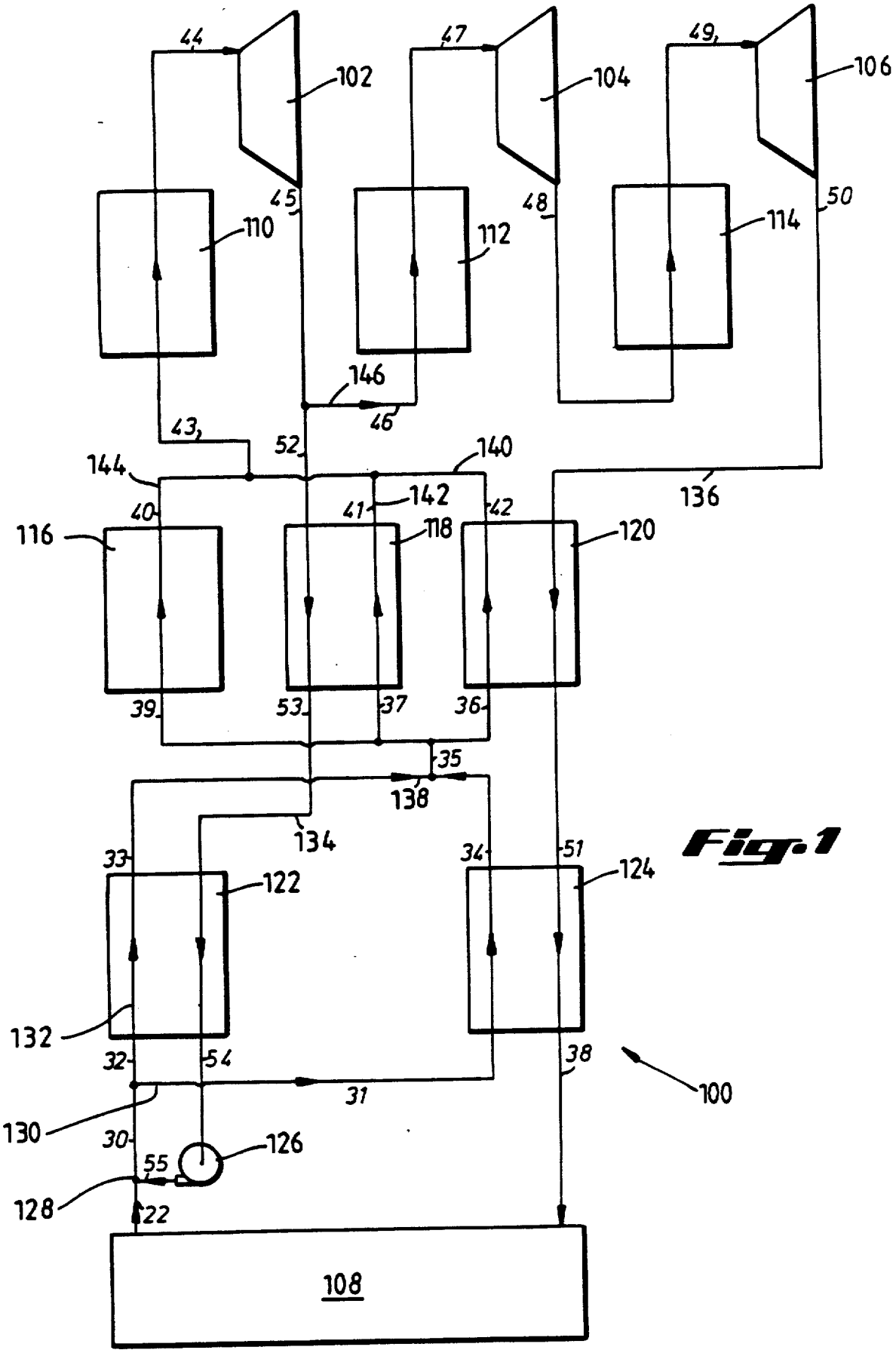
Figure 2:
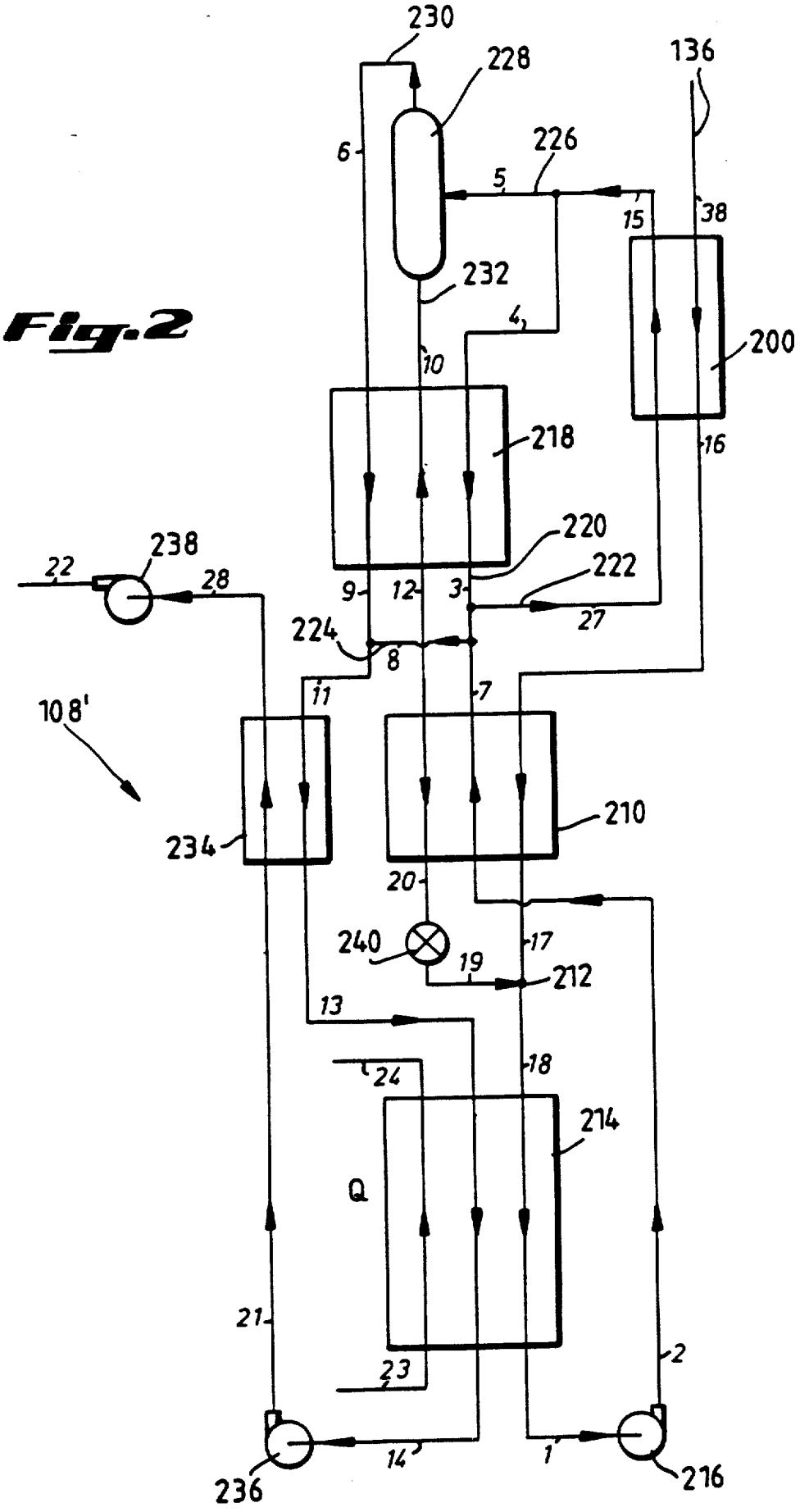

A Kalina cycle condensing subsystem 108', shown in FIG. 2, is advantageously used as a subsystem 108 in the system shown in FIG. 1. In order to condense the working fluid stream, a distillation-condensation subsystem is employed when the pressure of the incoming stream to the system 108 is substantially lower than the pressure necessary to provide condensation of the returning low pressure stream at normal ambient temperatures.

The stream from the path 136 is sent into a heat exchanger 200 where it is cooled and partially condensed, releasing heat. Thereafter the stream passes through the heat exchanger 210, where it is further cooled and condensed. The stream is then mixed with a stream of lean solution at the point 212. As will become apparent subsequently, the lean solution is a solution which contains a higher proportion of a higher boiling temperature component than the stream exiting from the heat exchanger 210. The new stream, called the basic solution, has an increased content of the higher boiling component in comparison with the returning low pressure stream and for this reason can be completely condensed by a cooling source such as water. After complete condensation in the condenser 214, the basic solution is pumped by a pump 216. The basic solution is then sent into the heat exchanger 210 where it is heated by the returning streams from the heat exchangers 200 and 218.

Usually the temperature of the flow heading from the heat exchanger 210 toward the heat exchanger 218 is slightly below the boiling temperature of the fluid. The stream is divided into three separate paths 220, 222 and 224. The fluid progressing along the path 222 is sent into the heat exchanger 200 where it is partially heated and partially evaporated. The stream progressing along the path 220 is sent into the heat exchanger 218. Thereafter, the streams 220 and 222 are recombined to form the stream 226.

The stream 226, a vapor-liquid mixture, passes through a gravity separator 228 where it is separated into lean stream 232 and rich stream 230. Both streams 230 and 232 are sent through the heat exchanger 218 counterflow to the stream 220. The rich stream 230 is enriched with the light (lower temperature boiling) component and is cooled and partially condensed in the heat exchanger 218.

The partially condensed rich stream is combined with the flow from the path 224 producing a working solution composition. The working solution composition passes through heat exchanger 234 where it is further cooled and condensed. From here it is finally sent into the condenser 214 where it is fully condensed by a cooling source.

The condensate is pumped by a pump 236 to an intermediate pressure. Thereafter, it is sent counterflow through heat exchanger 234 where it is preheated. After preheating the stream is finally pumped to a high pressure by the pump 238 where it exits from the subsystem 108'.

Returning now to the lean stream, which is enriched with the heavier (higher temperature boiling) component, exiting from the gravity separator 228 along the line 232, the lean stream is cooled in the heat exchanger 218. Then it is further cooled in the heat exchanger 210 providing heat for the output flow from the pump 216. Thereafter, the stream progressing along the path 232 is throttled by the throttle valve 240 and is mixed at 212 as described previously.

The parameters of flow at the various points indicated in FIGS. 1 and 2 are design variables that can be chosen in a way to obtain the maximum advantage from the system 100. One skilled in the art will be able to select the design variables to maximize performance under the various conditions and circumstances that may be encountered, while achieving a heat balance. The parameters of the various process points, shown in FIG. 1, are subject to considerable variation depending on specific circumstances.

In order to further illustrate the advantages that can be obtained by the present invention, a set of calculations were performed. In these calculations, an illustrative power cycle in accordance with the system shown in FIGS. 1 and 2 was selected wherein the working fluid was a water-ammonia mixture. The parameters for the theoretical calculations (assumed ambient temperature 60° F.) which were performed utilized standard ammonia-water enthalpy-concentration diagrams. In the following table the points set forth in the first column correspond to the points in FIGS. 1 and 2. The column headed by the letter "G" shows the weight of the fluid at each point in proportion to the weight of fluid at the point 38.

TABLE I

| Point No. | Temp. (°F.) | Press. (PSI) | Enthalpy (BTU/lb) | $NH_4$ Concentration (lbs $NH_4$/Total Wt.) | G (lb/lb) |
|---|---|---|---|---|---|
| 1 | 60.00 | 21.10 | −75.04 | .4196 | 4.7337 |
| 2 | 60.33 | 93.42 | −74.72 | .4196 | 4.7337 |
| 3 | 118.41 | 72.42 | −13.32 | .4196 | 1.1421 |
| 4 | 144.50 | 70.92 | 81.72 | .4196 | 1.1421 |
| 5 | 148.50 | 70.92 | 97.40 | .4196 | 4.2459 |
| 6 | 148.50 | 70.92 | 618.06 | .9671 | .5122 |
| 7 | 118.41 | 73.42 | −13.32 | .4196 | 4.7337 |
| 8 | 118.41 | 72.42 | −13.32 | .4196 | .4878 |
| 9 | 122.81 | 69.42 | 574.78 | .9671 | .5122 |
| 10 | 148.50 | 70.92 | 25.98 | .3445 | 3.7337 |
| 11 | 121.68 | 69.42 | 287.88 | .7000 | 1.0000 |
| 12 | 126.64 | 60.92 | 2.84 | .3445 | 3.7337 |
| 13 | 99.13 | 68.42 | 213.40 | .7000 | 1.0000 |
| 14 | 60.00 | 67.42 | −51.63 | .7000 | 1.0000 |
| 15 | 149.99 | 70.92 | 103.17 | .4196 | 3.1037 |
| 16 | 123.17 | 23.10 | 419.73 | .7000 | 1.0000 |
| 17 | 75.33 | 22.10 | 277.77 | .7000 | 1.000 |
| 18 | 84.53 | 22.10 | 29.51 | .4196 | 4.7337 |
| 19 | 86.13 | 22.10 | −36.98 | .3445 | 3.7337 |
| 20 | 88.69 | 50.92 | −36.98 | .3445 | 3.7337 |
| 21 | 60.60 | 186.88 | −51.01 | .7000 | 1.0000 |
| 22 | 127.92 | 2560.00 | 23.43 | .7000 | 1.0000 |
| 23 | 52.00 | — | — | WATER | 25.84 |
| 24 | 81.41 | — | — | WATER | 25.84 |
| 27 | 118.41 | 72.42 | −13.32 | .4196 | 3.1037 |
| 28 | 117.68 | 181.88 | 11.91 | .7000 | 1.0000 |
| 30 | 145.71 | 2560.00 | 43.57 | .7000 | 1.4614 |
| 31 | 145.71 | 2560.00 | 43.57 | .7000 | .3705 |
| 32 | 145.71 | 2560.00 | 43.57 | .7000 | 1.0909 |
| 33 | 384.51 | 2460.00 | 362.57 | .7000 | 1.0909 |
| 34 | 384.51 | 2460.00 | 362.57 | .7000 | .3705 |
| 35 | 384.51 | 2460.00 | 362.57 | .7000 | 1.4614 |
| 36 | 384.51 | 2460.00 | 362.57 | .7000 | .3002 |
| 37 | 384.51 | 2460.00 | 362.57 | .7000 | .0482 |
| 38 | 181.52 | 24.10 | 781.28 | .7000 | 1.0000 |
| 39 | 384.51 | 2460.00 | 362.57 | .7000 | 1.1130 |
| 40 | 697.62 | 2435.00 | 1008.57 | .7000 | 1.1130 |
| 41 | 697.62 | 2435.00 | 1008.57 | .7000 | .0482 |
| 42 | 697.62 | 2435.00 | 1008.57 | .7000 | .3002 |
| 43 | 697.62 | 2435.00 | 1008.57 | .7000 | 1.4614 |
| 44 | 1050.00 | 2400.00 | 1275.85 | .7000 | 1.4614 |
| 45 | 799.05 | 756.07 | 1124.30 | .7000 | 1.4614 |
| 46 | 799.05 | 756.07 | 1124.30 | .7000 | 1.0000 |
| 47 | 1050.00 | 731.07 | 1291.96 | .7000 | 1.0000 |
| 48 | 722.15 | 152.00 | 1084.92 | .7000 | 1.0000 |
| 49 | 1050.00 | 127.00 | 1297.04 | .7000 | 1.0000 |
| 50 | 732.62 | 30.10 | 1093.38 | .7000 | 1.0000 |
| 51 | 399.51 | 27.10 | 899.47 | .7000 | 1.0000 |
| 52 | 799.05 | 756.07 | 1124.30 | .7000 | .4614 |
| 53 | 393.51 | 753.07 | 831.98 | .7000 | .4614 |
| 54 | 175.52 | 743.07 | 77.76 | .7000 | .4614 |
| 55 | 183.57 | 2560.00 | 87.23 | .7000 | .4614 |

The cycle with the parameters as set forth in Table I was calculated to have a total net electrical output of 598.32 BTU with a total heat input of 1385.65 BTU. Thus, the net thermal efficiency was 43.2%. The calculated total pump work was 18.04 BTU.

When the disclosed system is utilized in connection with low grade fuel such as municipal waste, these calculations indicate that efficiency could be improved as much as 25% or more over conventional systems.

While the present invention has been described with respect to a single preferred embodiment, those skilled in the art will appreciate a number of variations and modifications therefrom and it is intended within the appended claims to cover all such variations and modifications as fall within the true spirit and scope of the present invention.

What is claimed is:

1. A method for implementing a thermodynamic cycle comprising the steps of:

expanding a gaseous working fluid including at least two components having different boiling points to transform its energy into useable form;

splitting said expanded gaseous working fluid into first and second streams;

expanding said first stream to a spent low pressure level to transform its energy into useable form;

subjecting at least a portion of said first stream having an initial composition of higher and lower boiling components to distillation at an intermediate pressure in a distillation system to distill or evaporate part of the stream and thus generate an enriched vapor fraction which is enriched with a lower boiling component relatively to both a rich working fluid fraction and a lean working fluid fraction;

mixing the enriched vapor fraction with part of the first stream and absorbing it therein to produce at least one rich working fluid fraction which is enriched relatively to a composite working fluid with a lower boiling component;

generating at least one lean working fluid fraction from part of the first stream, the lean working fluid fraction being impoverished relatively to such a composite working fluid with a lower boiling component;

using a remaining part of the first stream as a condensation stream;

condensing vapor contained in the rich and lean working fluid fractions to the extent that it is present;

increasing the pressures of the rich and lean working fluid fractions in liquid form to a charged high pressure level;

mixing the lean and rich working fluid fractions to generate a composite working fluid;

condensing the composite working fluid in a absorption stage by cooling and absorbing it in the condensation stream at a pressure lower than the intermediate pressure to regenerate the first stream;

mixing the second stream into the said first stream after preheating at least a portion of said mixed stream with the second stream; and evaporating said mixed stream to form the gaseous working fluid.

2. The method of claim 1 wherein the step of expanding said first stream includes the steps of reheating said first stream and then expanding said first stream to a spent low pressure level.

3. The method of claim 2 including the steps of reheating and then expanding said first stream and reheating and expanding again to reach a spent low pressure level.

4. The method of claim 1 including the step of pumping said second stream to a pressure substantially equal to the pressure of the first stream at the point before the first and second streams are mixed together.

5. A method of claim 1 including the step of using said first stream after said first stream has been expanded to a spent low pressure level to preheat the mixed stream.

6. The method of claim 5 including the step of splitting said mixed stream into at least two flows and preheating at least one of said flows with heat from said first stream after said first stream has been expanded to a spent low pressure level.

7. A method for implementing a thermodynamic cycle comprising the steps of:

expanding a gaseous working fluid to transform its energy into useable form;

splitting said expanded gaseous working fluid into first and second streams;

expanding said first stream to a spent low pressure level to transform its energy into useable form;

condensing said first stream;

mixing the second stream into said first stream after preheating at least a portion of said mixed stream with the first and second streams;

splitting said mixed stream into at least two flows and preheating at least one of said flows with heat from said first stream after said first stream has been expanded to a spent low pressure level; and evaporating said mixed stream to form the gaseous working fluid.

* * * * *

UNITED STATES PATENT AND TRADEMARK OFFICE
CERTIFICATE OF CORRECTION

PATENT NO. : 4,763,480

DATED : August 16, 1988

INVENTOR(S) : Alexander I. Kalina

It is certified that error appears in the above-identified patent and that said Letters Patent is hereby corrected as shown below:

The title page showing the illustrative Figure should be deleted to appear as per attached title page.

The sheet of Drawing containing Figures 1-4 should be deleted to be replaced with Figures 1-2 as shown on the attached sheet.

On the title page "1 Drawing Sheet" should read --2 Drawing Figures--.

Signed and Sealed this

Fifteenth Day of November, 1988

*Attest:*

DONALD J. QUIGG

*Attesting Officer*

*Commissioner of Patents and Trademarks*

United States Patent [19]

Kalina

[11] Patent Number: 4,763,480

[45] Date of Patent: Aug. 16, 1988

[54] METHOD AND APPARATUS FOR IMPLEMENTING A THERMODYNAMIC CYCLE WITH RECUPERATIVE PREHEATING

[76] Inventor: Alexander I. Kalina, 12214 Clear Fork, Houston, Tex. 77077

[21] Appl. No.: 920,281

[22] Filed: Oct. 17, 1986

[51] Int. Cl.[4] ..... F01K 25/06

[52] U.S. Cl. ..... 60/649; 60/653; 60/673; 60/691

[58] Field of Search ..... 60/678, 649, 653, 654, 60/673, 691, 692, 693

[56] References Cited

U.S. PATENT DOCUMENTS 3,277,651 10/1966 Augsburger ..... 60/679 X
3,842,605 10/1974 Tegtmeyer ..... 60/678
3,921,406 11/1975 Teranishi et al. ..... 60/678 X
4,003,205 1/1977 Matsumura ..... 60/678 X
4,047,386 9/1977 Frondorf ..... 60/678 X

*Primary Examiner*—Stephen F. Husar
*Attorney, Agent, or Firm*—Arnold, White & Durkee

[57] ABSTRACT

A method and apparatus for implementing a thermodynamic cycle with preheating, involves expanding a gaseous working fluid to a medium pressure to transform its energy into usable form. The expanded gaseous working fluid is split into two different streams. One stream is further expanded to a spent low pressure level to produce further usable energy. This stream is then condensed. The other of the two streams is used to preheat the condensed stream and is mixed with the condensed stream at a point upstream of the point of preheating. This decreases the irreversibilities in the preheating process and enables greater efficiencies to be achieved.

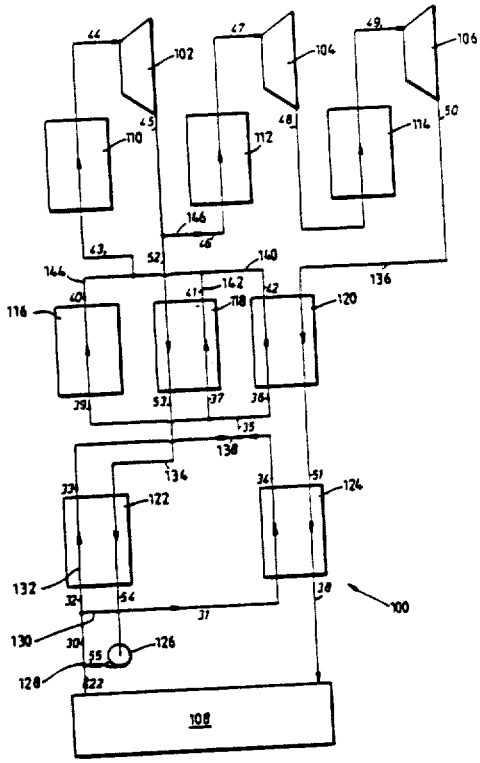

7 Claims, 1 Drawing Sheet